United States Patent [19]

Deitz et al.

[11] Patent Number: 4,756,385

[45] Date of Patent: Jul. 12, 1988

[54] FOLD TOGETHER SAW BENCHES

[76] Inventors: Robert L. Deitz, c/o George Spector, 233 Broadway, RM 3815; George Spector, 233 Broadway, RM 3815, both of New York, N.Y. 10007

[21] Appl. No.: 79,719

[22] Filed: Jul. 30, 1987

[51] Int. Cl.[4] ..... B27B 21/00

[52] U.S. Cl. ..... 182/153; 182/225

[58] Field of Search ..... 182/153, 181–186, 182/224–226

[56] References Cited

U.S. PATENT DOCUMENTS

| | | | |
|---|---|---|---|
| 673,968 | 5/1901 | Ross | 182/153 |
| 1,819,252 | 8/1931 | Linsner | 182/153 |
| 1,819,780 | 8/1931 | Kraut | 182/153 |
| 2,825,606 | 3/1958 | Rebensdorf | 182/153 |
| 4,245,718 | 1/1981 | Poston | 182/181 |
| 4,319,663 | 3/1982 | Barden | 182/181 |
| 4,403,678 | 9/1983 | Zieg | 182/153 |
| 4,429,765 | 2/1984 | Garcia | 182/153 |
| 4,620,613 | 11/1986 | Albertson | 182/153 |

*Primary Examiner*—Reinaldo P. Machado

[57] ABSTRACT

A foldable sawhorse is provided and consists of two parts that are hinged together so that it can be stored without taking up a lot of space. In a modification the sawhorse can be adjusted to various heights by simply forcing the legs together and apart.

2 Claims, 1 Drawing Sheet

FOLD TOGETHER SAW BENCHES

BACKGROUND OF THE INVENTION

The instant invention relates generally to sawhorses and more specifically it relates to a foldable sawhorse.

Numerous sawhorses have been provided in prior art that are adapted to be both portable and collapsible for storage. For example, U.S. Pat. Nos. 4,245,718; 4,319,663 and 4,429,765 all are illustrative of such prior art. While these units may be suitable for the particular purpose to which they address, they would not be as suitable for the purposes of the present invention as heretofore described.

SUMMARY OF THE INVENTION

A primary object of the present invention is to provide a foldable sawhorse that will overcome the shortcomings of the prior art devices.

Another object is to provide a foldable sawhorse that can be stored without taking up alot of space and could be easily hauled from one place to another.

An additional object is to provide a foldable sawhorse that is adjustable to various heights simply by forcing the legs together or apart.

A further object is to provide a foldable sawhorse that is simple and easy to use.

A still further object is to provide a foldable sawhorse that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
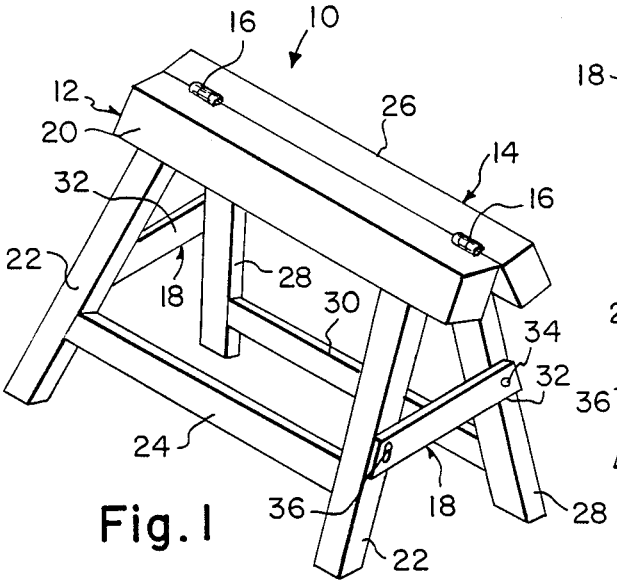
FIG. 1 is a perspective view of the invention in position for use.
Figure 2:
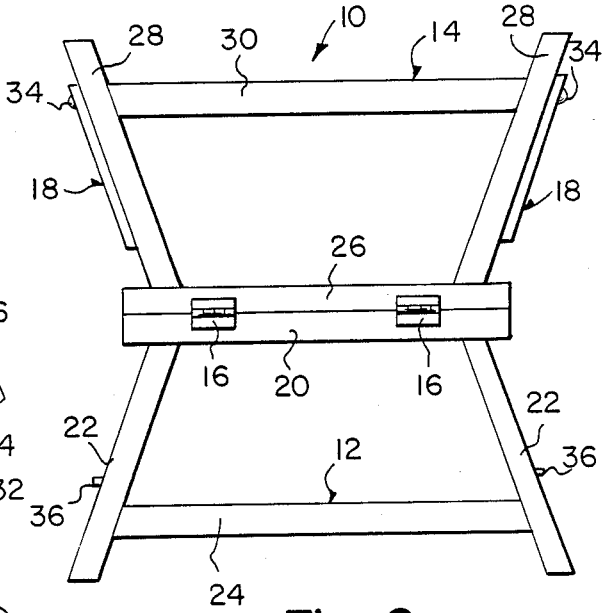
FIG. 2 is a front view of the invention in an open flat position.

Turning now descriptively to the drawings, in which similar reference characters denote similar elements throughout the several views, FIGS. 1 and 2 illustrate a foldable sawhorse 10 that basically consists of a first part 12, a second part 14, a pair of hinges 16 therebetween and a structure 18 for selectively preventing pivotal movement of the first part 12 relative to the second part 14.

The first part 12 has a first elongated crossbar 20, a first pair of substantially parallel spaced apart legs 22 extending from the first crossbar 20 and a first brace 24 extending between the first pair of legs 22. The second part 14 has a second elongated crossbar 26, a second pair of substantially parallel spaced apart legs 28 extending from the second crossbar 26 and a second brace 30 extending between the second pair of legs 28. The hinges 16 are spaced apart and connect the first elongated crossbar 20 to the second elongated crossbar 26 to accommodate pivotal movement of the first and second parts 12 and 14 between a first position (not shown) in which the legs 22 and 28 of the parts 12 and 14 abut and are substantially parallel and a second position in which the crossbars 20 and 26 of the parts 12 and 14 abut so that the legs 22 and 28 of the parts 12 and 14 are in alignment with each other as shown in FIG. 2. The first and second positions can be used for storage. The structure 18 keeps the first pair of legs 22 in a spreading position relative to the second pair of legs 28 to support a load (not shown) on the crossbars 20 and 26. The structure 18 includes a pair of arms 32. Each of the arms 32 is pivotly connected at 34 and extends from one of the second pair of legs 28 to one of the first pair of legs 20 to be removably connected thereto at pin 36.

Figure 3:
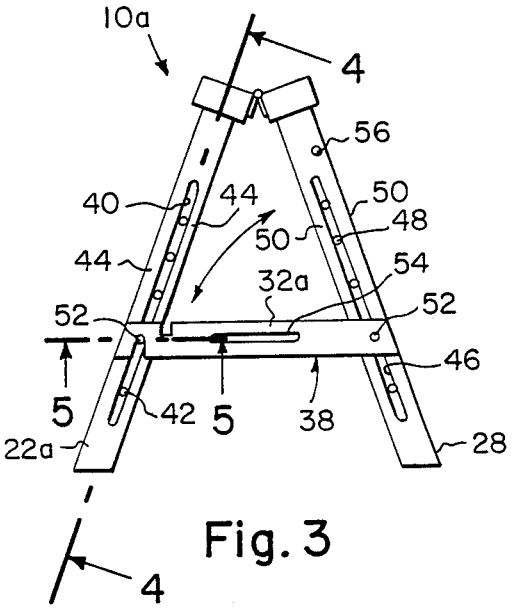
FIG. 3 is a side view of a modification in which forcing legs together or apart will cause the bolts to move out of oversize holes and move to next holes.
Figure 4:
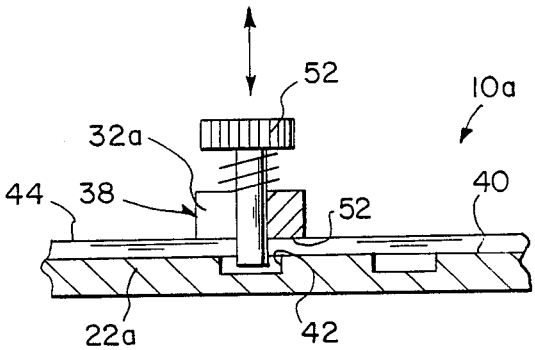
FIG. 4 is an enlarged cross sectional view taken along line 4—4 in FIG. 3.
Figure 5:
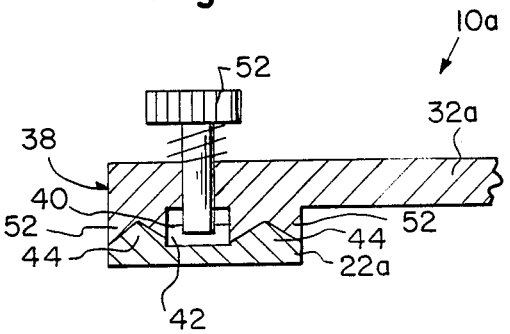
FIG. 5 is an enlarged cross sectional view taken along line 5—5 in FIG. 3.

FIGS. 3, 4 and 5 show a modified foldable sawhorse **10*a* further containing a mechanism 38 for adjusting the spreading position of the first pair of legs 22*a* relative to the second pair of legs 28*a* to change the overall height of the sawhorse 10*a*. Each of the first pair of legs 22*a* has a substantially vertical elongated side slot 40 with a plurality of spaced apart oversized recesses 42 therein and a pair of elongated double bevel wedges 44, each of which runs parallel on one side of the slot 40. Each of the second pair of legs 28*a* has a substantially vertical elongated side slot 46 with a plurality of spaced apart oversized recesses 48 therein and a pair of elongated double bevel wedges 50, each of which runs parallel on one side of the slot 46**.

Each of the arms **32*a* has a pair of double bevel cam surfaces 52 on each end thereof so as to normally mate with the double bevel wedges 44 and 50. Two pair of spring biased stop bolts 52 are provided, each of which is disposed on one end of each of the arms 32*a* to engage with one of the oversized recesses 42, 48 in one of the slots 40, 46. When the first and second pair of legs 22*a* and 28*a* are forced together the stop bolts 52 will move up and out of the recesses 42 and 48 allowing the arms 32*a* to move for adjustment. When the first and second pair of legs 22*a* and 28*a* are forced apart the stop bolts 52 will move up and out of the recesses 42 and 48 allowing the arms 32*a*** to move for adjustment.

As shown in FIG. 3, each of the arms **32*a* also includes a handle 54 thereon to facilitate removal of the arm 32*a* from connection to one of the first pair of legs 22*a* to a stored position on pin 56 on one of the second pair of legs 28*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A foldable sawhorse which comprises:

(a) a first part having a first elongated crossbar, a first pair of substantially parallel spaced apart legs extending from the first crossbar and a first brace extending between the first pair of legs;

(b) a second part having a second elongated crossbar, a second pair of substantially parallel spaced apart legs extending from the second crossbar and a second brace extending between the second pair of legs;

(c) a pair of hinges spaced apart and connecting said first elongated crossbar to said second elongated crossbar to accommodate pivotal movement of said first and second parts between a first position in which the legs of said parts abut and are substantially parallel and a second position in which the cross bars of said parts abut so that the legs of said parts are in alignment with each other, the first and second positions can be used for storage;

(d) means for selectively preventing pivotal movement of said first part relative to said second part so as to keep the first pair of legs in a spreading position relative to the second pair of legs to support a load on the crossbars, wherein said pivotal preventing means includes a pair of arms, each of said arms pivotly connected to and extending from one of the second pair of legs to one of the first pair of legs to be removeably connected thereto, further comprising means for adjusting the spreading position of the first pair of legs relative to the second pair of legs to change the overall height of said sawhorse, wherein said adjusting means includes:

(e) each of the first pair of legs having a substantially vertical elongated side slot with a plurality of spaced apart oversized recesses therein and a pair of elongated double bevel wedges, each of which runs parallel on one side of the slot;

(f) each of the second pair of legs having a substantially vertical elongated side slot with a plurality of spaced apart oversized recesses therein and a pair of elongated double bevel wedges, each of which runs parallel on one side of the last named slot;

(g) each of said arms having a pair of double bevel cam surfaces on each end thereof so as to normally mate with the double bevel wedges; and (h) two pair of inwardly spring biased stop bolts each of which is disposed on one end of each of said arms to engage with one of said oversized recesses in one of said slots whereby when the first and second pair of legs are forced together said stop bolts will move up and out of the recesses allowing said arms to move for adjustment and when the first and second pair of legs are forced apart said stop bolts will move up and out of the recesses.

2. A foldable sawhorse as recited in claim 1, wherein each of said arms further includes a handle thereon to faciliate removal of said arm from connection to one of the first paid of legs to a stored position on one of the second pair of legs.

* * * * *